United States Patent [19]

Braun

[11] Patent Number: 4,578,862

[45] Date of Patent: Apr. 1, 1986

[54] SHEAR ELEMENT FOR A HAIR CUTTER

[75] Inventor: Gebhard Braun, Kelkheim, Fed. Rep. of Germany

[73] Assignee: Braun Aktiengesellschaft, Kronberg, Fed. Rep. of Germany

[21] Appl. No.: 721,484

[22] Filed: Apr. 8, 1985

Related U.S. Application Data

[63] Continuation of Ser. No. 484,640, Apr. 13, 1983, abandoned.

[30] Foreign Application Priority Data

Apr. 15, 1982 [DE] Fed. Rep. of Germany ..... 3213834

[51] Int. Cl.[4] ..... B26B 19/02

[52] U.S. Cl. ..... 30/43.92; 30/233.5; 30/346.51

[58] Field of Search ..... 30/43.9, 43.92, 200, 30/233.5, 278, 279 R, 346.51

[56] References Cited

U.S. PATENT DOCUMENTS

| | | | |
|---|---|---|---|
| 2,206,551 | 7/1940 | Muros | 30/43.92 |
| 2,214,069 | 9/1940 | Sikora | 30/201 |
| 2,256,076 | 9/1941 | Coles | 30/31 |
| 2,292,858 | 8/1942 | Alexay | 30/43 |
| 2,355,898 | 8/1944 | Saxe | 30/43.92 |
| 2,572,777 | 10/1931 | Steinbach | 30/43.92 |

FOREIGN PATENT DOCUMENTS

| | | |
|---|---|---|
| 7923598 | 8/1979 | Fed. Rep. of Germany . |
| 496350 | 2/1936 | United Kingdom . |

*Primary Examiner*—Douglas D. Watts

*Attorney, Agent, or Firm*—Raymond J. De Vellis

[57] ABSTRACT

In a shear element for a dry shaving or hair cutting apparatus, the shear element being provided with hair inlet openings having an entry zone and a cutting zone, the improvement wherein a first approach edge is provided intermediate the entry zone and the cutting zone, the first approach edge being substantially perpendicular to a longitudinal axis of the entry zone, whereby a guidance path is provided which changes direction at least twice between the entry zone and the cutting zone.

2 Claims, 4 Drawing Figures

SHEAR ELEMENT FOR A HAIR CUTTER

This application is a continuation of application Ser. No. 484,640, filed Apr. 13, 1983, now abandoned.

BACKGROUND OF THE INVENTION

1. Field of the Invention

This invention relates to a shear element for dry shavers and hair cutters used to remove hair at soft, yielding skin areas, e.g., the neck and armpits. Such shear elements are frequently provided with slot-shaped hair inlets, having an entry zone for initially receiving and guiding the hair shafts and a cutting zone adjacent a cutter bar. They may be shear combs having slots opening to one side which are fabricated from flat material or fabricated by bending thin metal sheets. Alternatively, they may be shear foils in which the hair inlet openings are provided as slots having a closed circumference.

2. Description of the Prior Art

Shear elements having slot-shaped hair inlets are known in the art. See, for example U.S. Pat. No. 2,292,858. A drawback encountered with the use of such shear elements is that small folds of the user's skin may reach the cutting zone along with the hair and thus be injured or irritated.

One approach to overcoming this drawback is to make the inlet openings relatively small. However, the shear effect is thereby severely impaired.

Great Britain Pat. No. 496,350 shows slot-shaped inlet openings designed with a one-sided curvature of sickle shape or at a slant to the main direction of operation of the device to thereby impede the entry of skin folds into the cutting zone.

However, practical experience has shown that, if a skin fold has entered the inlet opening due to circular or eratic directional movements of the shaving device, the skin fold can easily follow the slanted or one-sidedly curving pattern of the inlet opening to reach the cutting zone and there be injured or irritated.

SUMMARY OF THE INVENTION

One object of the present invention is to provide a shear element which will effectively and closely shave hair while avoiding irritation and/or injury to the skin.

In general, the invention features an improvement in a shear element provided with hair inlet openings having an entry zone and a cutting zone, wherein a first approach edge is provided intermediate the entry and cutting zones, the first approach edge being substantially perpendicular to a longitudinal axis of the entry zone, such that a guidance path is provided which changes direction at least twice between the entry zone and the cutting zone.

A shear element so constructed allows close shaving of relatively long hairs while preventing small skin folds from reaching the cutting zone. Skin folds entering the entry zone are intercepted and braked by the first approach edge, while the double change in direction of the guidance path prevents skin from reaching the cutting zone by a direct route.

To improve hair entry, the entry zone may be of relatively greater width than the cutting zone. However, this also allows skin folds more ready access to the hair inlet openings.

Consequently, in one embodiment having a widened entry zone, the first approach edge is formed by a protrusion which substantially covers the cutting zone, and a second approach edge is provided which is longitudinally offset from the first approach edge. The two mutually displaced approach edges and the resulting quadruple change in direction of the guidance path are highly effective in preventing skin folds which have penetrated the entry zone from reaching the cutting zone.

In yet another embodiment, the hair inlet openings are provided with at least two parallel cutting zones disposed symmetrically and separated by a web. Two diametrically opposed protrusions form two of three approach edges and a central opening therebetween. A third approach edge is formed by the front of the web which is disposed opposite the central opening.

These and other features of the invention will now be disclosed through a description of a number of preferred embodiments, reference being had to the accompanying drawings, wherein:

DESCRIPTION OF THE PREFERRED EMBODIMENTS

Figure 1:
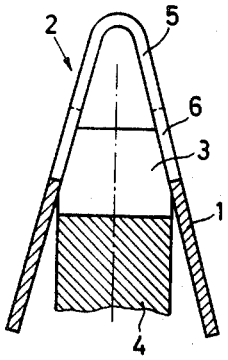
FIG. 1 is a sectional view through the shear element of a hair cutter embodying the invention.

Referring now to FIG. 1, a dry shaver or hair cutter for cutting relatively lengthy hair includes a stationary shear element 1 (essentially a V-shaped bent piece of sheet metal) having slot-shaped inlet openings 2. Also provided is a moving shear element 4 having comb-like teeth 3. Inlet openings 2, various detailed embodiments of which are shown in FIGS. 2, 3 and 4, are provided with an entry zone 5 and a cutting zone 6, adjacent to which moving shear element 4 passes.

Figure 2:
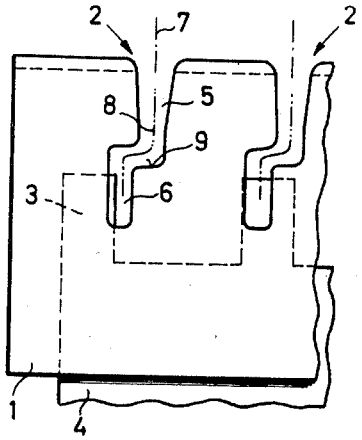
FIG. 2 is an elevational view of a first embodiment of the shear element of FIG. 1.

In the first embodiment of FIG. 2, entry zone 5 is not significantly wider than cutting zone 6, which is laterally offset with respect to entry zone 5 (having a longitudinal axis 7). As a result, the guidance path 8 undergoes a double change of direction, and, as viewed from the perspective of entry zone 5, there is provided an approach edge 9 which is essentially perpendicular to longitudinal axis 7. Approach edge 9 provides resistance to any entering skin folds and prevents them from reaching cutting zone 6 through a direct route.

Figure 3:
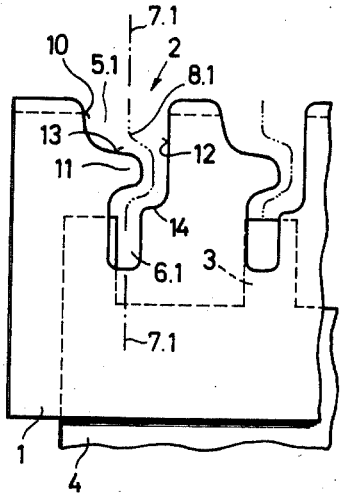
FIG. 3 is an elevational view of a second embodiment of the shear element of FIG. 2.

In the second embodiment shown in FIG. 3, entry zone 5.1 is significantly expanded with respect to cutting zone 6.1. At one edge 10 of entry zone 5.1, there is provided a protrusion 11 extending substantially perpendicular to longitudinal axis 7.1. Protrusion 11 extends in the direction of the opposite edge 12 for a distance sufficient to substantially cover cutting zone 6.1. Guidance path 8.1 is guided about protrusion 11 in labyrinthine fashion with a quadruple change of direction. Protrusion 11 forms (as viewed from the perspective of entry zone 5.1) a first approach edge 13. Opposite edge 12 is similarly provided with a perpendicularly extending second approach edge 14 also disposed substantially perpendicular with respect to longitudinal axis 7.1 but longitudinally offset from first approach edge 13.

Figure 4:
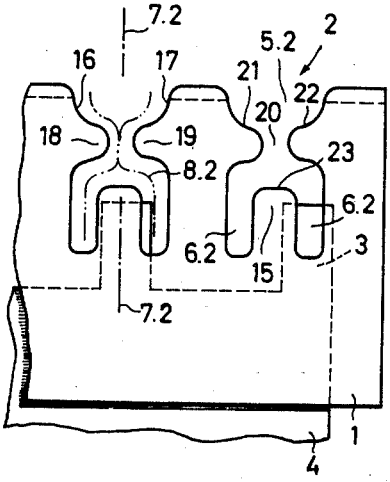
FIG. 4 is an elevational view of a third embodiment of the shear element of FIG. 1.

The third embodiment of the hair inlet shown in FIG. 4 is provided with an expanded entry zone 5.2 and two substantially parallel cutting zones 6.2, separated by a web 15 and disposed essentially symmetrically with respect to longitudinal axis 7.2. Two diametrically opposed protrusions 18 and 19 extend from the edges 16 and 17, respectively, of inlet opening 2 to thereby provide an intermediate opening 20 therebetween, the width of which is on the order of the width of one of cutting zones 6.2. The front edge of web 15 is disposed adjacent and in opposition to opening 20. Protrusions 18 and 19 form, respectively, first and second approach edges 21 and 22 while the front side of web 15 forms a third approach edge 23. In this third embodiment, protrusions 18 and 19 likewise obstruct any direct path from entry zone 5.2 to cutting zones 6.2 and cause a multiple change of direction of guidance path 8.2. Entering skin folds are braked and halted by the three approach edges 21, 22 and 23.

While the present invention has been described by way of a number of preferred embodiments, various substitutions of equivalents may be effected which do not depart from the spirit or scope of the invention as set forth in the following claims.

What is claimed as new and desired to be secured by Letters Patent of the United States is:

1. A shear element for a dry shaver or hair cutter comprising a plurality of hair inlet openings, said shear element being adapted to mount over a moving inner shear blade having cutting teeth, said moving inner shear blade extending only partially into the interior of said shear element thereby dividing said hair inlet openings into a cutting zone proximate said cutting teeth such that a cutting action is produced by the cooperation of said shear element and said shear blade in the area of said cutting zone, and an entry zone, of expanded width with respect to said cutting zone, located above said cutting zone and said cutting teeth, wherein substantially no cutting action is produced; and a first and second approach edge provided intermediate said entry zone and said cutting zone, said first approach edge being formed by a protrusion which substantially covers said cutting zone and said first approach edge being disposed substantially perpendicular to a longitudinal axis of said entry zone, said second approach edge being longitudinally spaced from said first approach edge, thereby providing an obstructed path from the longitudinal axis of said entry zone to the longitudinal axis of said cutting zone, whereby a guidance path is provided that changes direction at least twice between said entry zone and said cutting zone.

2. The shear element as in claim 1, wherein said hair inlet openings are provided with at least two of said cutting zones separated by a web and disposed essentially symmetrically with respect to said entry zone, and wherein at least three approach edges are provided, two of said approach edges being formed by protrusions which are substantially diametrically opposed to form a central opening therebetween and to substantially cover said cutting zone, and the third of said approach zones being formed by an edge of said web displaced adjacent said opening.

* * * * *